US009987179B2

(12) United States Patent
Melgarejo et al.

(10) Patent No.: US 9,987,179 B2
(45) Date of Patent: Jun. 5, 2018

(54) ADJUSTABLE WHEELCHAIR ARRANGEMENTS

(71) Applicant: Freedom Designs, Inc., Simi Valley, CA (US)

(72) Inventors: Mauricio Melgarejo, Simi Valley, CA (US); Michael H. Nordquist, Longmont, CO (US); Alejandro Melgarejo, Simi Valley, CA (US)

(73) Assignee: Freedom Designs, Inc., Simi Valley, CA (US)

( * ) Notice: Subject to any disclaimer, the term of this patent is extended or adjusted under 35 U.S.C. 154(b) by 80 days.

(21) Appl. No.: 15/079,814

(22) Filed: Mar. 24, 2016

(65) Prior Publication Data

US 2017/0273840 A1 Sep. 28, 2017

(51) Int. Cl.
*A61G 5/10* (2006.01)

(52) U.S. Cl.
CPC .... *A61G 5/1075* (2013.01); *A61G 2005/1083* (2013.01); *A61G 2005/1089* (2013.01)

(58) Field of Classification Search
CPC ..... A61G 5/1075
USPC ..... 280/250.1, 304.1
See application file for complete search history.

(56) References Cited

U.S. PATENT DOCUMENTS

| | | | |
|---|---|---|---|
| 4,941,709 | A | 7/1990 | Moller |
| 5,074,620 | A | 12/1991 | Jay et al. |
| 5,176,393 | A | 1/1993 | Robertson et al. |
| 5,564,786 | A | 10/1996 | Peek et al. |
| 5,667,235 | A | 9/1997 | Pearce et al. |
| 5,848,824 | A | 12/1998 | Mocur |
| 5,947,562 | A | 9/1999 | Christofferson et al. |
| 6,126,186 | A | 10/2000 | Mascari |
| 6,206,393 | B1 | 3/2001 | Mascari et al. |
| 6,352,307 | B1 | 3/2002 | Engman |
| 7,007,965 | B2 | 3/2006 | Bernatsky et al. |
| 8,235,407 | B2 | 8/2012 | Cerreto et al. |
| 8,474,848 | B2 | 7/2013 | Bernatsky et al. |

*Primary Examiner* — Tony H Winner
(74) *Attorney, Agent, or Firm* — Calfee, Halter & Griswold LLP

(57) ABSTRACT

An adjustable wheelchair includes a base frame having a first guide portion defining a first arcuate channel, and a seat frame having a second guide portion defining a second arcuate channel confronting the first arcuate channel. A first bearing assembly is secured to a front end of the first arcuate channel and extends into bearing engagement with the second arcuate channel. A rear bearing assembly is secured to a rear end of the second arcuate channel and extends into bearing engagement with the first arcuate channel. The seat frame is slideable in an arcuate path defined by the first and second arcuate channels for adjustment of a tilt angle of the seat frame with respect to the base frame.

13 Claims, 10 Drawing Sheets

ADJUSTABLE WHEELCHAIR ARRANGEMENTS

BACKGROUND

Wheelchairs and similar conveyances are an important means of transportation for a significant portion of society. Whether manual or powered, wheelchairs provide an important degree of independence for those they assist.

SUMMARY

The present application discloses exemplary embodiments of wheelchairs having adjustable seating frames, wheels, and other components and arrangements.

According to an exemplary aspect of the present application, a wheelchair may be providing with a seat tilting mechanism configured to provide for smooth manual tilting actuation across a range of positions, and secure attachment in a range of tilting positions.

In an exemplary embodiment, an adjustable wheelchair includes a base frame having a first guide portion defining a first arcuate channel, and a seat frame having a second guide portion defining a second arcuate channel confronting the first arcuate channel. A first bearing assembly is secured to a front end of the first arcuate channel and extends into bearing engagement with the second arcuate channel. A rear bearing assembly is secured to a rear end of the second arcuate channel and extends into bearing engagement with the first arcuate channel. The seat frame is slideable in an arcuate path defined by the first and second arcuate channels for adjustment of a tilt angle of the seat frame with respect to the base frame.

According to another exemplary aspect of the present application, a wheelchair may be providing with wheel attachment arrangements providing for adjustment of front and rear wheel attachment to the base frame of the wheel chair, for example, to provide for attachment of different size wheels, to adjust the vertical position the seat frame with respect to the ground, and/or to adjust the angular position of the seat frame on the base frame (e.g., to provide for a slight anterior tilt of the seat frame to facilitate getting out of the chair).

In an exemplary embodiment, an adjustable base frame for a wheelchair includes a longitudinally extending frame member and a front wheel caster assembly. The caster assembly includes a caster wheel rotatably secured to a stem portion, with the stem portion being affixed to a mounting bracket mounted to a front end portion of the frame member. The mounting bracket includes a first aperture closely receiving a first fastener threaded with an aligned first mounting hole in the front end portion of the frame member, an elongated second mounting aperture vertically spaced from, and longitudinally aligned with the first mounting aperture, receiving a second fastener threaded with an aligned second mounting hole in the front end portion of the frame member, and an eccentric third mounting aperture longitudinally spaced from the first and second mounting apertures. An eccentric camming plate is received in the eccentric third mounting aperture and including a third fastener extending therethrough and threaded with a third mounting hole in the front end portion of the frame member, the eccentric camming plate being tightened with the eccentric mounting hole by the third fastener to secure the front wheel caster in a selected angular position.

According to another exemplary aspect of the present application, a wheelchair may be providing with seat, arm, and cane attachment arrangements providing for adjustment of the seating area, arm supports, and canes on the seat frame, for example, with respect to the seat guide portions, to adjust the mass of the user on the chair to facilitate mobility and tilting.

In an exemplary embodiment, an adjustable seat frame for a wheelchair includes a front cross member, a rear cross member longitudinally spaced from the front cross member, a longitudinally extending first side frame member mounted to a first end portion of each of the front and rear cross members by first front and rear mounting brackets, and a longitudinally extending second side frame member mounted to a second end portion of each of the front and rear cross members by second front and rear mounting brackets, the first and second side frame members defining a seating area. Each of the first and second side frame members is independently longitudinally adjustable with respect to the front and rear cross members.

According to another exemplary aspect of the present application, cylindrical tubular frame members used, for example, with a wheelchair may be adapted to include flatted cylindrical portions providing one or more flatted surfaces for more secure, rigid attachment of flat mounting plates, mounting brackets, or other such accessories, for example, by fasteners installed through aligned mounting holes in the flatted tubular member and the mountable accessory.

In an exemplary embodiment, an adjustable seat frame for a wheelchair includes a front cross member, a rear cross member longitudinally spaced from the front cross member, a longitudinally extending first side frame member mounted to a first end portion of each of the front and rear cross members, and including a cylindrical portion and a flatted cylindrical portion, a longitudinally extending second side frame member mounted to a second end portion of each of the front and rear cross members, the first and second side frame members defining a seating area, and including a cylindrical portion and a flatted cylindrical portion, a first mounting bracket having a C-clamp end portion attached to the cylindrical portion of one of the first and second side frame members, and a second mounting bracket having flat first and second side walls attached to the flatted cylindrical portion of one of the first and second side frame members.

According to another aspect of the present application, rear anti-tip leg assemblies, provided on a back end of a wheelchair to provide support for the chair in the event that the chair is unintentionally tipped rearward about the rear wheels, may be adapted to be adjustably positioned on the base frame for easy pivoting of the leg assembly out of the way of a caregiver pushing the wheelchair or for more compact stowing of the wheelchair.

In an exemplary embodiment, a base frame assembly for a wheelchair includes a longitudinally extending side frame member, a rear wheel rotatable about an axle secured to a rear end portion of the side frame member, and an anti-tip leg assembly including a hollow base portion affixed to the rear end portion of the side frame member, rearward of the axle, a leg portion extending axially through the hollow base portion from a first end proximate the side frame member to a distal end having a ground engaging portion configured to support the wheelchair if the base frame is accidentally tipped rearward about the rear wheel. The leg portion is axially biased into a rotationally fixed position with the ground engaging portion in an anti-tip position. The first end of the leg portion is axially movable to a rotatable position to permit rotation of the leg portion for movement of the ground engaging portion to a disengaged position.

BRIEF DESCRIPTION OF THE DRAWINGS

Further features and advantages will become apparent to those of ordinary skill in the art to which the invention pertains from a reading of the following description together with the accompanying drawings, in which.

DETAILED DESCRIPTION

Figure 1:
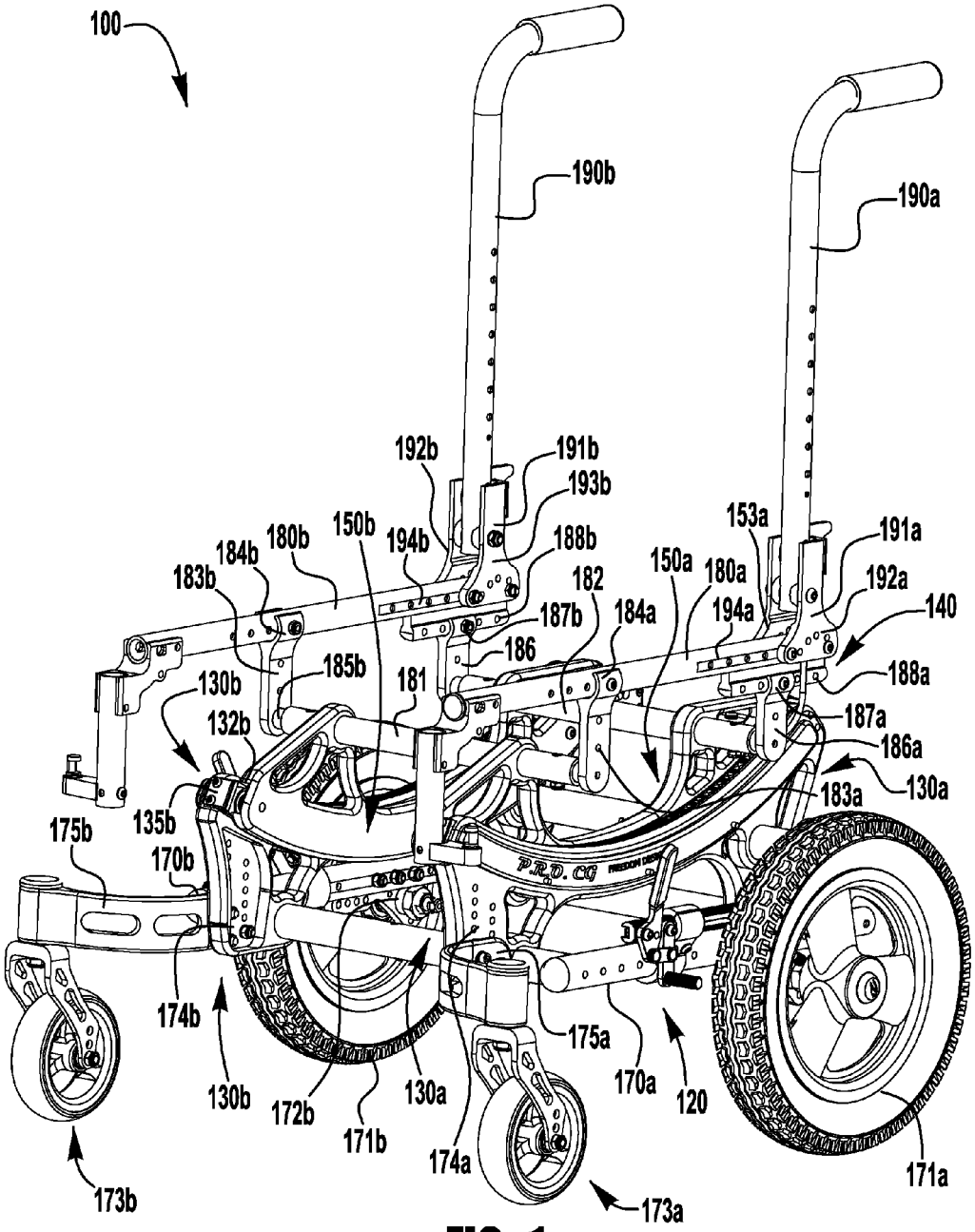
FIG. 1 is a front perspective view of a wheelchair in accordance with an exemplary embodiment.
Figure 2:
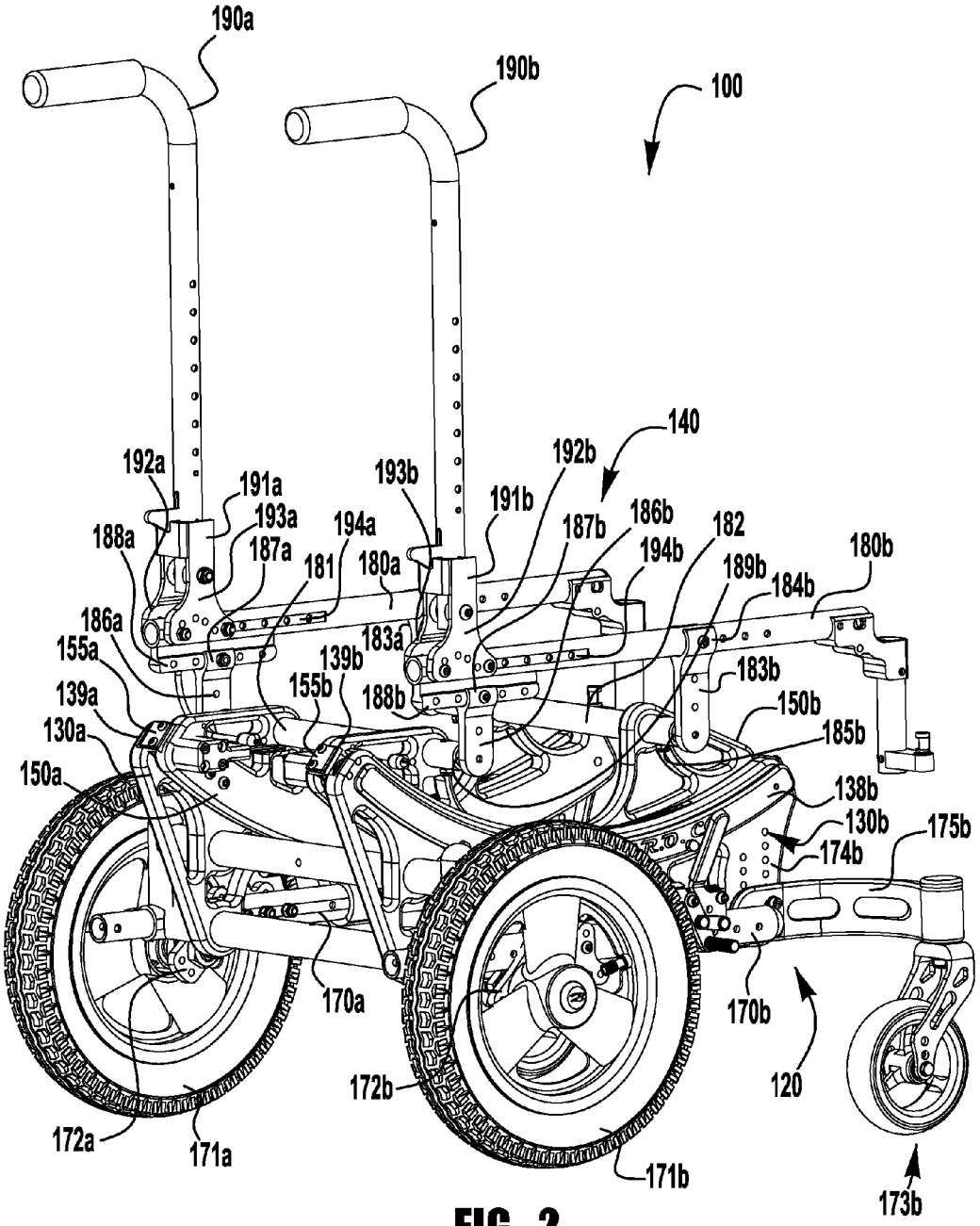
FIG. 2 is a rear perspective view of the wheelchair of FIG. 1.
Figure 3:
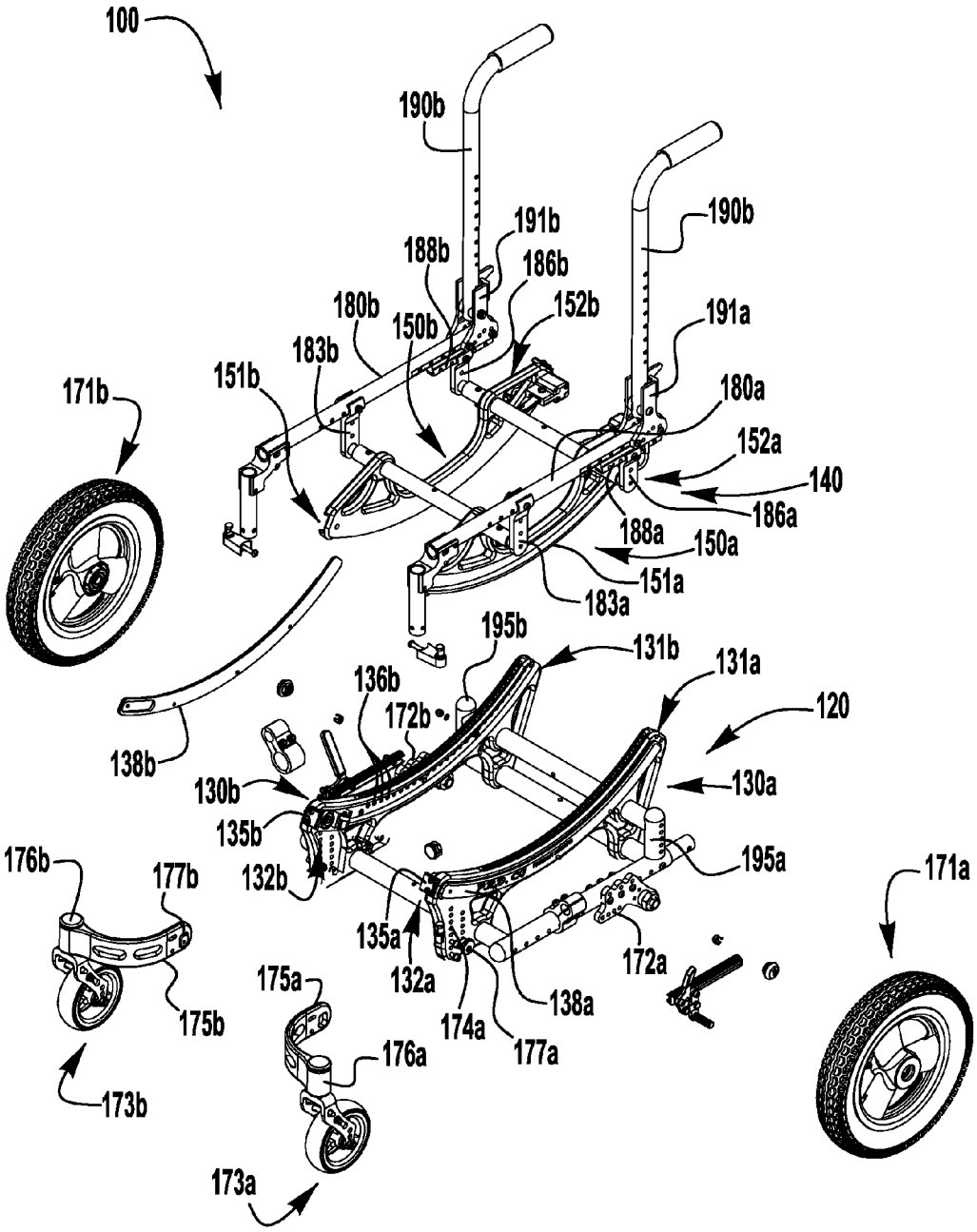
FIG. 3 is an exploded perspective view of the wheelchair of FIG. 1.
Figure 4:
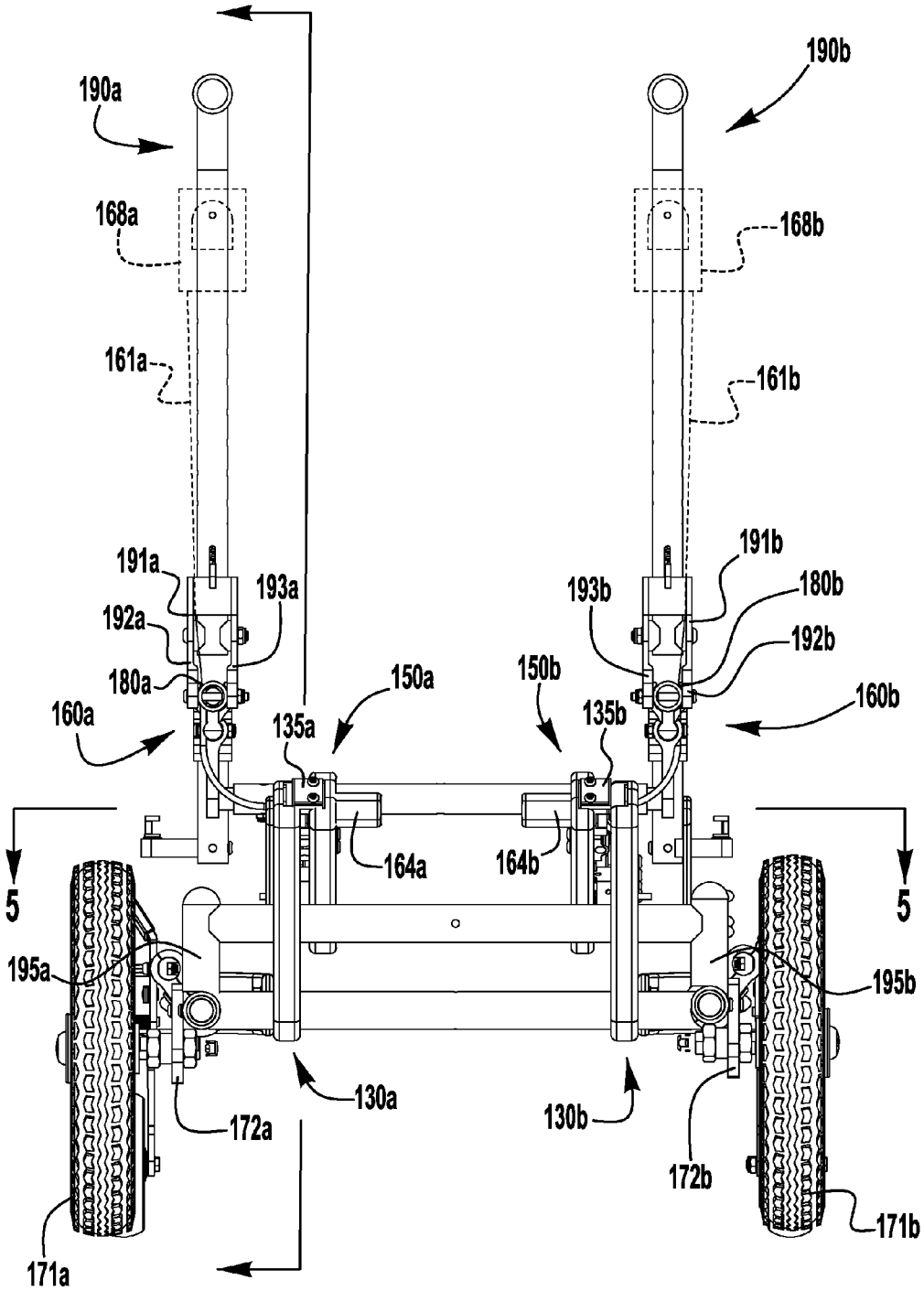
FIG. 4 is a rear view of the wheelchair of FIG. 1.
Figure 5:
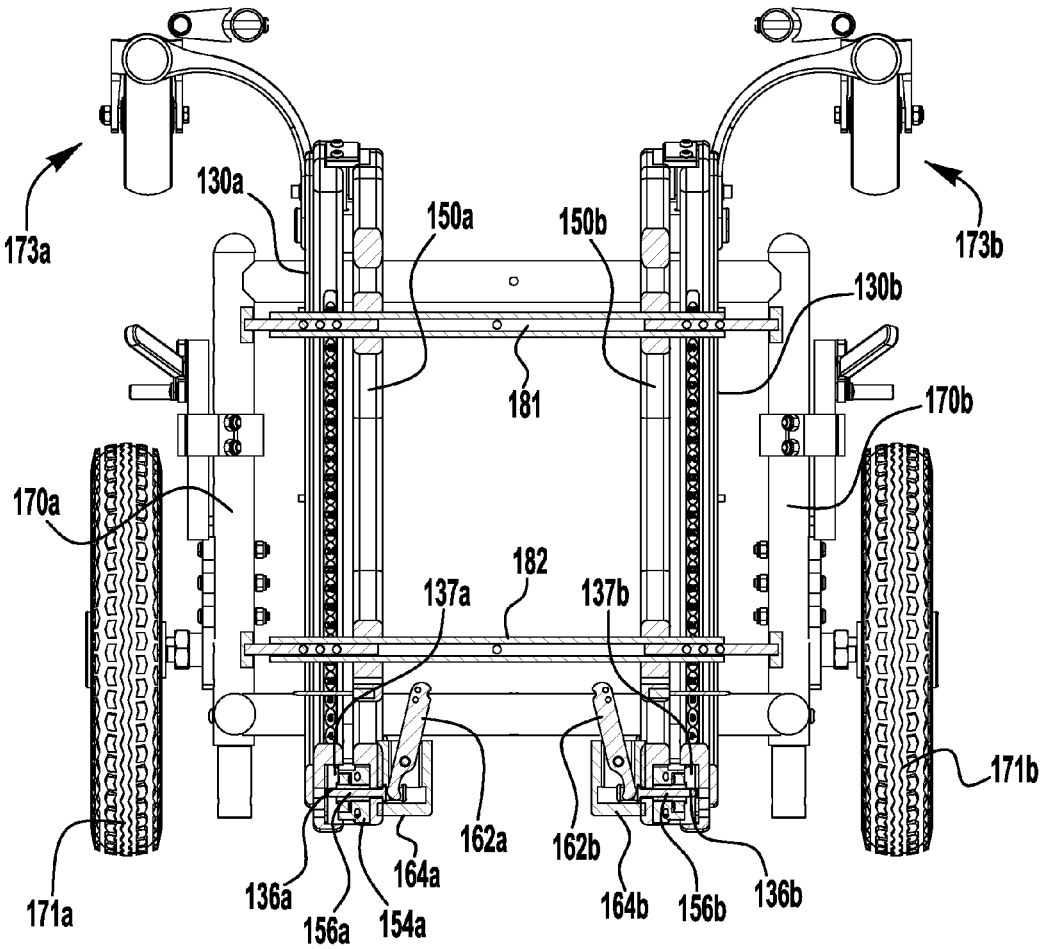
FIG. 5 is a cross-sectional top view of the wheelchair of FIG. 1, taken through line 5-5 of FIG. 4.
Figure 6:
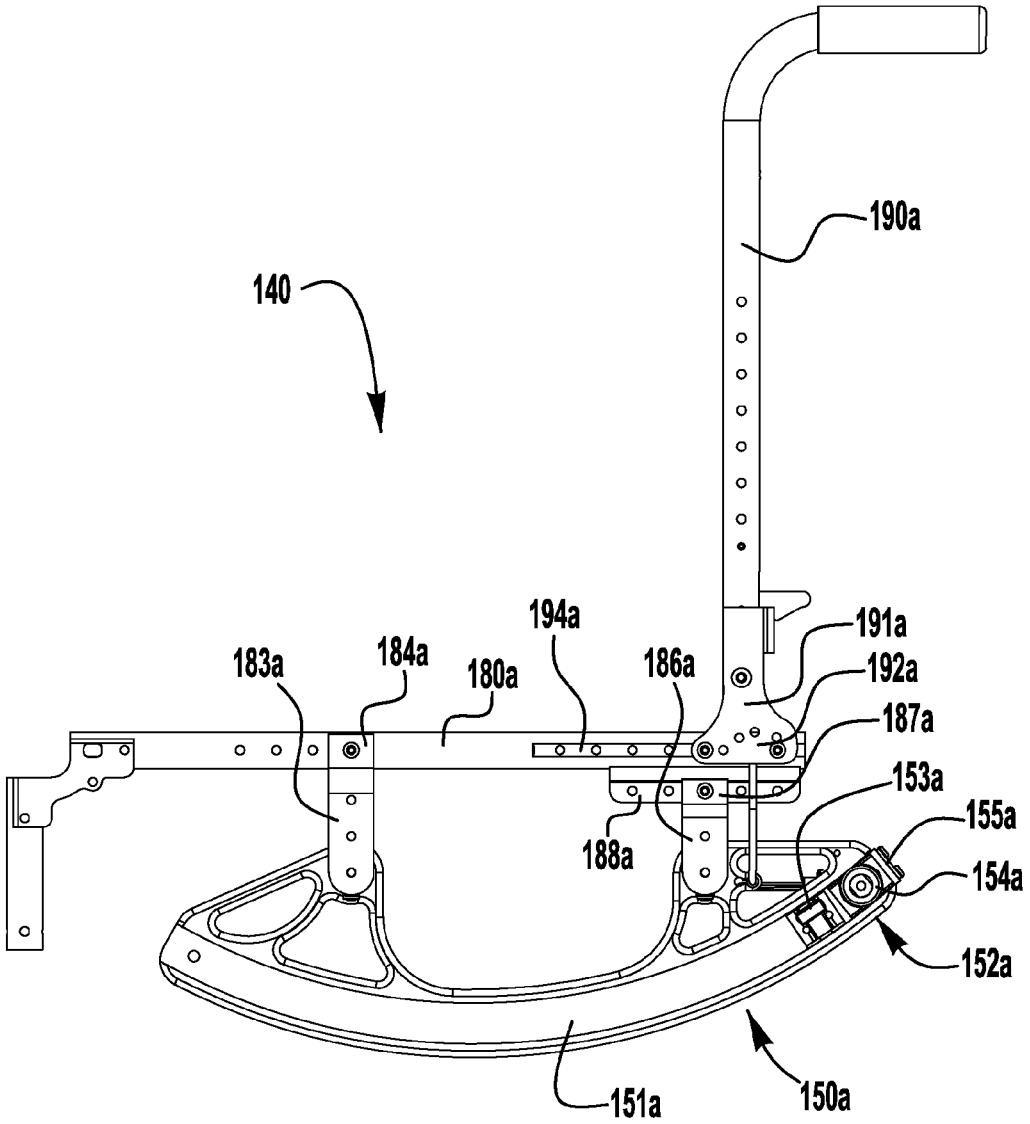
FIG. 6 is a side view of the seat frame of the wheelchair of FIG. 1.
Figure 7:
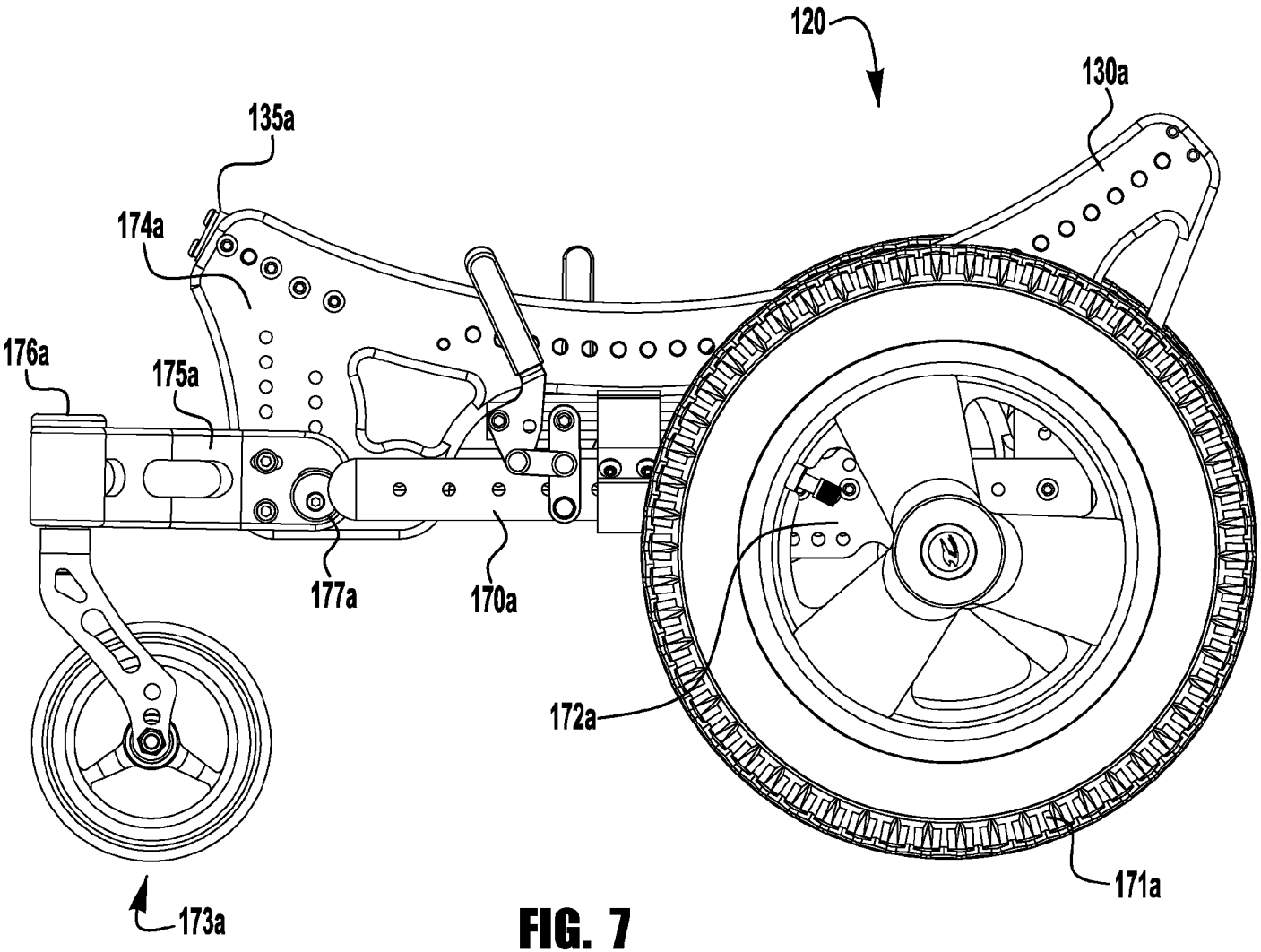
FIG. 7 is a side view of the base frame of the wheelchair of FIG. 1.
Figure 7A:
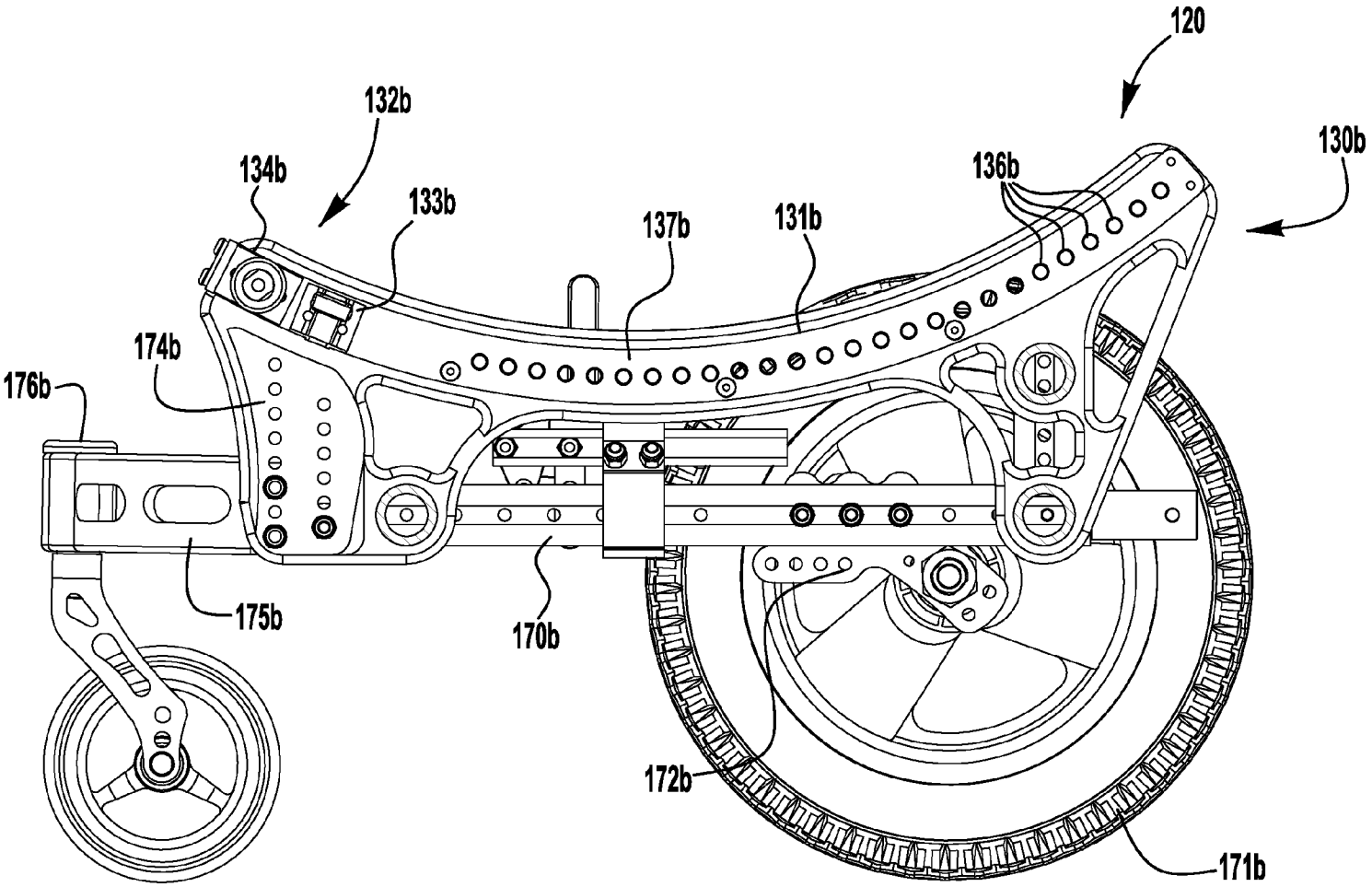
FIG. 7A is a side cross-sectional view of the base frame of the wheelchair of FIG. 1.

This Description merely describes exemplary embodiments and is not intended to limit the scope of the claims in any way. Indeed, the invention as claimed is broader than and unlimited by the exemplary embodiments, and the terms used in the claims have their full ordinary meaning.

As described herein, when one or more components are described as being connected, joined, affixed, coupled, attached, or otherwise interconnected, such interconnection may be direct as between the components or may be indirect, such as through the use of one or more intermediary components. Also as described herein, reference to a "member," "component," or "portion" shall not be limited to a single structural member, component, or element but can include an assembly of components, members or elements.

The present application describes exemplary embodiments of an adjustable wheelchair, operable or configurable to adjust one or more configurations of the wheelchair, including, for example, a tilt position of the seat frame with respect to the chair base frame, vertical and horizontal positioning of the seat frame on the base frame, and wheel configurations on the base frame.

According to an exemplary aspect of the present application, a tilting mechanism of an adjustable chair may utilize interengaging arcuate guides (e.g., tracks, sleeves, channels, rails, rods, series of bearings, etc.) disposed on the seat frame and the base frame, shaped to provide rotational tilting movement of the seat assembly about a fixed central axis, as defined by the center of curvature of the guides, due to sliding relative movement of the interengaging guides. In one such exemplary embodiment, the arcuate guides may be positioned and shaped such that the resulting central axis of rotation coincides with or is proximate to the center of gravity of a user seated in the adjustable chair, or the center of gravity of the user and seat in combination, such that movement of this center of gravity during a tilting operation is limited or minimized. This limited movement of the user's center of gravity may reduce resistance to tilting, requiring reduced operator effort to perform the tilting operation, and may improve chair stability by maintaining the user center of gravity in a location well supported by the seat assembly and positioning base, and at least one bearing member disposed on the other of the base and the seat assembly.

Many different arrangements or combinations of arrangements may be utilized to provide for ease of adjustment of a wheelchair seat tilt angle and secure retention of the seat in a selected angle. In an exemplary embodiment, an adjustable wheelchair includes a base frame having a first guide portion defining a first arcuate channel, and a seat frame having a second guide portion defining a second arcuate channel confronting the first arcuate channel. A first bearing assembly is secured to a front end of the first arcuate channel and extends into bearing engagement with the second arcuate channel. A rear bearing assembly is secured to a rear end of the second arcuate channel and extends into bearing engagement with the first arcuate channel. The seat frame is slideable in an arcuate path defined by the first and second arcuate channels for adjustment of a tilt angle of the seat frame with respect to the base frame.

FIGS. 1-7 illustrate an exemplary wheelchair 100 including a wheeled base frame 120 and a seat frame 140 adjustably positionable on the base frame. The base frame 120 includes first and second base guide frame members or base guide portions 130*a*, 130*b*, and the seat frame 140 includes first and second seat guide frame members or seat guide portions 150*a*, 150*b* that interengage with the base guide portions for relative arcuate sliding movement therewith, to adjust a tilting angle of the seat frame 140. In other embodiments (not shown), a single guide portion on each of the base frame and the seat frame may be sufficient to guide and support tilting movement of the seat frame on the base frame.

While many different types of sliding interengagement may be utilized, in the illustrated embodiment, the base guide portions 130*a*, 130*b* define inward facing base channels 131*a*, 131*b*, and the seat guide portions 150*a*, 150*b* define outward facing seat channels 151*a*, 151*b* confronting the inward facing channels. In another embodiment (not shown), the base guide portions may define outward facing base channels and the seat guide portions may define inward facing seat channels confronting the outward facing base channels.

In the illustrated embodiment, the base guide portions 130*a*, 130*b* include front bearing assemblies 132*a*, 132*b* secured in the front ends of the base channels 131*a*, 131*b* and extending laterally beyond the base channels for receipt in, and bearing engagement with, the seat channels 151*a*, 151*b*. Likewise, the seat guide portions 150*a*, 150*b* include rear bearing assemblies 152*a*, 152*b* secured in the rear ends of the seat channels 151*a*, 151*b* and extending laterally beyond the seat channels for receipt in, and bearing engagement with, the base channels 131*a*, 131*b*. This bearing arrangement limits bearing contact between the outer and inner guide portions 130*a*, 130*b*, 150*a*, 150*b* to front and rear bearing assembly engagement with the channels, for example, to provide for smoother tilting actuation due to reduced surface contact.

As the seat frame 140 reclines, the rear bearing assemblies 152*a*, 152*b* slide forward, with the seat channels 151*a*, 151*b*. When the seat frame 140 is in a fully reclined position, the rear bearing assemblies 152*a*, 152*b* are proximate to the front bearing assemblies 132*a*, 132*b*, substantially below the center of gravity of the user for weight bearing support of the user. Engagement of the rear bearing assemblies 152*a*, 152*b* with the front bearing assemblies 132*a*, 132*b* prevents sliding separation of the seat frame 140 from the base frame 120 when the seat frame is tilted to the fully reclined position. To prevent sliding separation of the seat frame 140 from the base frame 120 when the seat frame is tilted to the fully upright position, stop members 139*a*, 139*b* (shown in FIG. 2) may be attached (e.g., by fasteners) to rear end portions of the base guide portions 130*a*, 130*b*, at the rear ends of the base channels 131*a*, 131*b*. These stop members 139*a*, 139*b* may be removable from the base guide portions 130*a*, 130*b* to allow the seat frame 140 to be slidingly disassembled from the base frame 120 by releasing the latch mechanisms (as described below) and tilting the seat frame 140 past the upright position to disengage the rear bearing assemblies 152*a*, 152*b* from the base channels 131*a*, 131*b*. Removal of the seat frame 140 from the base frame 120 may, for example, facilitate cleaning, maintenance or storage of the wheelchair.

Many different types of bearing assemblies may be utilized for bearing engagement between the base and seat guide portions, including, for example, ball bearings and roller bearings. In the illustrated embodiment, each bearing assembly 132*a*, 132*b*, 152*a*, 152*b* includes a horizontal roller bearing 133*a*, 133*b*, 153*a*, 153*b* (i.e., having a radial, primarily vertical rotational axis) that engages a substantially vertical bottom surface of the opposed channel 131*a*, 131*b*, 151*a*, 151*b*, and a vertical roller bearing 134*a*, 134*b*, 154*a*, 154*b* (i.e., having a horizontal rotational axis) that engages the opposed side surfaces of the opposed channel 131*a*, 131*b*, 151*a*, 151*b*. This bearing arrangement limits relative movement of the guide portions in both the radial and lateral directions. To further minimize friction during tilting movement, self-lubricating stainless steel bearings may be used.

Each of the guide portions may be provided with wiper portions that extend into the opposed channels of the interengaging guide portions, for example, to clear the channels of debris or contaminants. In the illustrated embodiment, the base guide member 130*a*, 130*b* include front wiper plates 135*a*, 135*b* that extend into the seat channels 151*a*, 151*b* for wiping engagement with any debris within the channels. Likewise, the seat guide member 150*a*, 150*b* include rear wiper plates 155*a*, 155*b* that extend into the base channels 131*a*, 131*b* for wiping engagement with any debris within the channels.

According to another aspect of the present application, a seat frame may be selectively securable in a wide range of tilting positions, for example, between an upright position (e.g., with the seat back at about 0° with respect to vertical) and a fully reclined position (e.g., with the seat back at about 40° to about 60° with respect to vertical). In one such exemplary embodiment, the seat may be securable in a range of positions between about 0° and about 50° in 2° increments, providing for twenty-six different selectable tilting positions. In other embodiments, other ranges and other numbers of selectable positions may be provided.

Many different types of latching or securing arrangements may be utilized to secure the seat in the selected tilt position. In one embodiment, one of the base guide portions and the seat guide portions includes a series of positioning recesses along an arcuate length of the corresponding channel, and the other of the base guide portions and the seat guide portions includes laterally adjustable bolt (e.g., pin, plate, block, bar) extending from the corresponding channel. The bolt is extendable into a selected one of the positioning recesses to secure the seat in a selected tilt position, and is retractable from the positioning recess to permit tilting adjustment.

Many different types of retractable bolt arrangements may be utilized to facilitate tilting adjustment and latching of the seat frame. In the illustrated embodiment, each of the seat guide portions 150*a*, 150*b* includes a retractable latch pin 156*a*, 156*b* that is receivable in one of a plurality of positioning recesses 136*a*, 136*b* disposed in the base channels 131*a*, 131*b* of the base guide portions. To facilitate engagement of the latch pin 156*a*, 156*b* with a selected recess 136*a*, 136*b*, the pin may be spring biased toward the extended position, and may include a contoured end surface (e.g., rounded), such that the spring force acts to facilitate alignment of the pin with the recess. As shown, the latch pins 156*a*, 156*b* may extend through hollow center shaft portions of the rear vertical roller bearings 154*a*, 154*b*. As shown, the recesses 136*a*, 136*b* may comprise holes in plate portions 137*a*, 137*b* that define the bottom surfaces of the base channels 131*a*, 131*b*. The base guide portions 130*a*, 130*b* may include arcuate cover members 138*a*, 138*b* that are removable to expose the outer ends of the positioning recesses 136*a*, 136*b*, for example, for cleaning, or to access a stuck latch pin. In another embodiment (not shown), the positioning recesses may be disposed in the channels of the seat guide portions and the latch pins may be carried by the base guide portions.

In the illustrated embodiment, the latch pin is retracted by a cable actuated lever mechanism 160*a*, 160*b*, including a cable 161*a*, 161*b* that is attached at a first end to a hand grip trigger 168*a*, 168*b* (shown schematically in phantom in FIG. 4), or foot pedal or other actuator (not shown) and at a second end (e.g., by a clamp member) to a pin actuating lever 162*a*, 162*b* (FIG. 5) pivotably connected to pin-retaining housing 164*a*, 164*b*. When the cable 161*a*, 161*b* is pulled in tension by the actuator, the cable pivots the lever 162*a*, 162*b* to retract the pin 156*a*, 156*b* against the biasing spring for disengagement from the recess 136*a*, 136*b*. When the actuator is released, the spring force extends the latch pin 156*a*, 156*b* against the base channel plate portion 137*a*, 137*b*, with the contoured end surface of the latch pin facilitating engagement of the pin with a selected positioning recess 136*a*, 136*b* when the pin is brought into at least partial alignment with the recess. In the illustrated embodiment, each pair of guide portions 130*a*, 150*a*, 130*b*, 150*b* includes a latching mechanism to provide two latching points for the seat frame in the selected tilt position. In other embodiments, one latching mechanism (e.g., on only one pair of guide portions on one side of the wheelchair) may be sufficient to provide a securely latched condition. In still other embodiments, more than two latching mechanisms may be used (e.g., two latching mechanisms on each side).

According to another aspect of the present application, a wheelchair may be providing with wheel attachment arrangements providing for adjustment of front and rear wheel attachment to the base frame of the wheel chair, for example, to provide for attachment of different size wheels, to adjust the vertical position the seat frame with respect to the ground, and/or to adjust the angular position of the seat frame on the base frame (e.g., to provide for a slight anterior tilt of the seat frame to facilitate getting out of the chair). In an exemplary embodiment, an adjustable base frame for a wheelchair includes a longitudinally extending frame member and a front wheel caster assembly. The caster assembly includes a caster wheel rotatably secured to a stem portion, with the stem portion being affixed to a mounting bracket mounted to a front end portion of the frame member. The mounting bracket includes a first aperture closely receiving a first fastener threaded with an aligned first mounting hole in the front end portion of the frame member, an elongated second mounting aperture vertically spaced from, and longitudinally aligned with the first mounting aperture, receiving a second fastener threaded with an aligned second mounting hole in the front end portion of the frame member, and an eccentric third mounting aperture longitudinally spaced from the first and second mounting apertures. An eccentric caroming plate is received in the eccentric third mounting aperture and including a third fastener extending therethrough and threaded with a third mounting hole in the front end portion of the frame member, the eccentric camming plate being tightened with the eccentric mounting hole by the third fastener to secure the front wheel caster in a selected angular position.

In the illustrated embodiment, rear wheel assemblies 171*a*, 171*b* are attached to base side frame members 170*a*, 170*b* (shown in the illustrated embodiment as cylindrical tubes) of the base frame 120 by rear wheel mounting brackets 172*a*, 172*b*. The mounting brackets include multiple rows of mounting apertures oriented to allow for mounting the rear wheel assemblies 171*a*, 171*b* (to mounting holes in the side frame members) in multiple vertical positions with respect to the side frame members 170*a*, 170*b*. The rear wheel mounting brackets 172*a*, 172*b* may also be flipped (upside-down) to orient the axle receiving holes of the brackets above the side frame members, to position the rear wheel axles above the side frame members. The side frame members 170*a*, 170*b* include multiple longitudinally spaced mounting holes oriented to allow for mounting the rear wheel assemblies 171*a*, 171*b* in multiple longitudinal positions with respect to the side frame members 170*a*, 170*b*. Front caster wheel assemblies 173*a*, 173*b* are attached to the front ends mounting portions 174*a*, 174*b* (shown in the illustrated embodiment as flat, plate-like extensions) of the base guide frame members 130*a*, 130*b* by front caster brackets or caster journals 175*a*, 175*b*. The front end mounting portions 174*a*, 174*b* including multiple rows of mounting holes oriented to allow for mounting the front caster wheel assemblies 173*a*, 173*b* in multiple vertical positions with respect to the base guide frame members 130*a*, 130*b*, for example, to adjust the vertical position of the seat frame (e.g., by repositioning both front casters and rear wheels) or to adjust an angular position of the seat frame (e.g., by repositioning only the front casters). As shown, an upper mounting aperture in each caster mounting bracket 175*a*, 175*b* may be elongated and arcuate to permit adjustment of the angular orientation of the front caster wheel assemblies 173*a*, 173*b* to maintain a stem portion 176*a*, 176*b* of each front caster wheel assembly in a vertical orientation. An eccentric camming adjustment plate 177*a*, 177*b* may be assembled with a complementary shaped mounting aperture in each caster mounting bracket 175*a*, 175*b*, such that tightening of the corresponding bolt (extending through the adjustment plate) causes the adjustment plate to secure the caster wheel assembly in this vertical stem orientation.

According to still another aspect of the present application, a wheelchair may be providing with seat, arm, and cane attachment arrangements providing for adjustment of the seating area, arm supports, and canes on the seat frame, for example, with respect to the seat guide portions, to adjust the mass of the user on the chair to facilitate mobility and tilting. In an exemplary embodiment, an adjustable seat frame for a wheelchair includes a front cross member, a rear cross member longitudinally spaced from the front cross member, a longitudinally extending first side frame member mounted to a first end portion of each of the front and rear cross members by first front and rear mounting brackets, and a longitudinally extending second side frame member mounted to a second end portion of each of the front and rear cross members by second front and rear mounting brackets, the first and second side frame members defining a seating area. Each of the first and second side frame members is independently longitudinally adjustable with respect to the front and rear cross members.

In the illustrated embodiment, the seat frame 140 includes seat side frame members 180*a*, 180*b* attached to front and rear cross members 181, 182 (shown in the illustrated embodiment as cylindrical tubes) by front and rear seat mounting brackets 183*a*, 183*b*, 186*a*, 186*b*. The front mounting brackets 183*a*, 183*b* include C-clamp ends 184*a*, 184*b* sized to attach (e.g., using bolts or other fasteners) to tubular front ends of the side frame members 180*a*, 180*b*, and tubular extensions 185*a*, 185*b* (e.g., welded to a plate portion of the bracket) positioned to be telescopically received in the front cross member 181, and secured by bolts or other fasteners. The rear mounting brackets 186*a*, 186*b* include clamp ends 187*a*, 187*b* sized to attach (e.g., using bolts or other fasteners) to rail portions 188*a*, 188*b* attached (e.g., welded) to bottom surfaces of tubular rear ends of the side frame members 180*a*, 180*b*, and tubular extensions 189*a*, 189*b* (e.g., welded to a plate portion of the bracket) positioned to be telescopically received in the rear cross member 182, and secured by bolts or other fasteners.

As shown, the side frame members 180*a*, 180*b* may be independently longitudinally adjustable (e.g., to adjust seat and/or footrest positioning) by removing the fasteners attaching the clamp ends 184*a*, 184*b*, 187*a*, 187*b* to the side frame members, and sliding the side frame members to a selected longitudinal position in which selected mounting holes in the side frame members align with the mounting apertures in the clamp ends, and reinstalling the fasteners. In one embodiment, the clamp ends 184*a*, 184*b*, 187*a*, 187*b* may include a low friction coating or bearing insert to facilitate sliding adjustment of the side frame members, and to minimize marring of the sliding surfaces). The side frame members 180*a*, 180*b* may be independently laterally adjustable (e.g., to adjust a width of the seat frame for receiving a seating pan, not shown) by removing the fasteners attaching the tubular extensions 185*a*, 185*b*, 189*a*, 189*b* to the cross members 181, 182, and sliding the side frame members to a selected lateral position in which selected mounting apertures (not shown) in the tubular extensions align with mounting holes in the cross members, and reinstalling the fasteners.

According to another exemplary aspect of the present application, cylindrical tubular frame members used, for example, with a wheelchair may be adapted to include flatted cylindrical portions providing one or more flatted surfaces for more secure, rigid attachment of flat mounting plates, mounting brackets, or other such accessories, for example, by fasteners installed through aligned mounting holes in the flatted tubular member and the mountable accessory.

In an exemplary embodiment, an adjustable seat frame for a wheelchair includes a front cross member, a rear cross member longitudinally spaced from the front cross member, a longitudinally extending first side frame member mounted to a first end portion of each of the front and rear cross members, and including a cylindrical portion and a flatted cylindrical portion, a longitudinally extending second side frame member mounted to a second end portion of each of the front and rear cross members, the first and second side frame members defining a seating area, and including a cylindrical portion and a flatted cylindrical portion, a first mounting bracket having a C-clamp end portion attached to the cylindrical portion of one of the first and second side frame members, and a second mounting bracket having flat first and second side walls attached to the flatted cylindrical portion of one of the first and second side frame members.

A pair of handle canes 190*a*, 190*b* are attached to the rear end portions of the side frame members 180*a*, 180*b* by U-shaped mounting brackets 191*a*, 191*b* attached to the canes by fasteners through aligned mounting holes. The U-shaped brackets 191*a*, 191*b* include side walls 192*a*, 192*b*, 193*a*, 193*c* that extend over the sides of the side frame members with multiple mounting apertures for adjustable (e.g., vertically, angularly) attachment of the side walls to selected ones of the multiple mounting holes on the side frame members (e.g., for longitudinal adjustment). To provide more rigid attachment of the U-shaped brackets 191*a*, 191*b* to the side frame members 180*a*, 180*b*, the rear portions of the side frame members may be provided with flatted side portions 194*a*, 194*b* that extend along the lengths of the rear mounting portions of the side frame members, for flat mating contact between the bracket side walls 192*a*, 192*b*, 193*a*, 193*b* and the flatted side portions 194*a*, 194*b*. To allow for flatted side surfaces, tubing with a greater wall thickness may be used to allow for removal of material to form the flats. This maintains a cylindrical interior surface to facilitate telescoping attachment of other features where appropriate. As shown in the illustrated embodiment, central and forward portions of the side frame members 180*a*, 180*b* may maintain a cylindrical exterior surface, for example, to facilitate proper attachment of conventional seat pans, leg rests, and other accessories (not shown). While other frame members of the illustrated embodiment are shown as cylindrical tubes, in other embodiments, one or both sides of one or more of the other tube-shaped frame members may be flatted to provide similar rigid attachment to a bracket or other attaching portion.

According to another aspect of the present application, rear anti-tip leg assemblies, provided on a back end of a wheelchair to provide support for the chair in the event that the chair is unintentionally tipped rearward about the rear wheels, may be adapted to be adjustably positioned on the base frame for easy pivoting of the leg assembly out of the way of a caregiver pushing the wheelchair or for more compact stowing of the wheelchair.

In an exemplary embodiment, a base frame for a wheelchair includes a longitudinally extending side frame member, a rear wheel rotatable about an axle secured to a rear end portion of the side frame member, and an anti-tip leg assembly including a hollow base portion affixed to the rear end portion of the side frame member, rearward of the axle, a leg portion extending axially through the hollow base portion from a first end proximate the side frame member to a distal end having a ground engaging portion configured to support the wheelchair if the base frame is accidentally tipped rearward about the rear wheel. The leg portion is axially biased into a rotationally fixed position with the ground engaging portion in an anti-tip position. The first end of the leg portion is axially movable to a rotatable position to permit rotation of the leg portion for movement of the ground engaging portion to a disengaged position.

Figure 9:
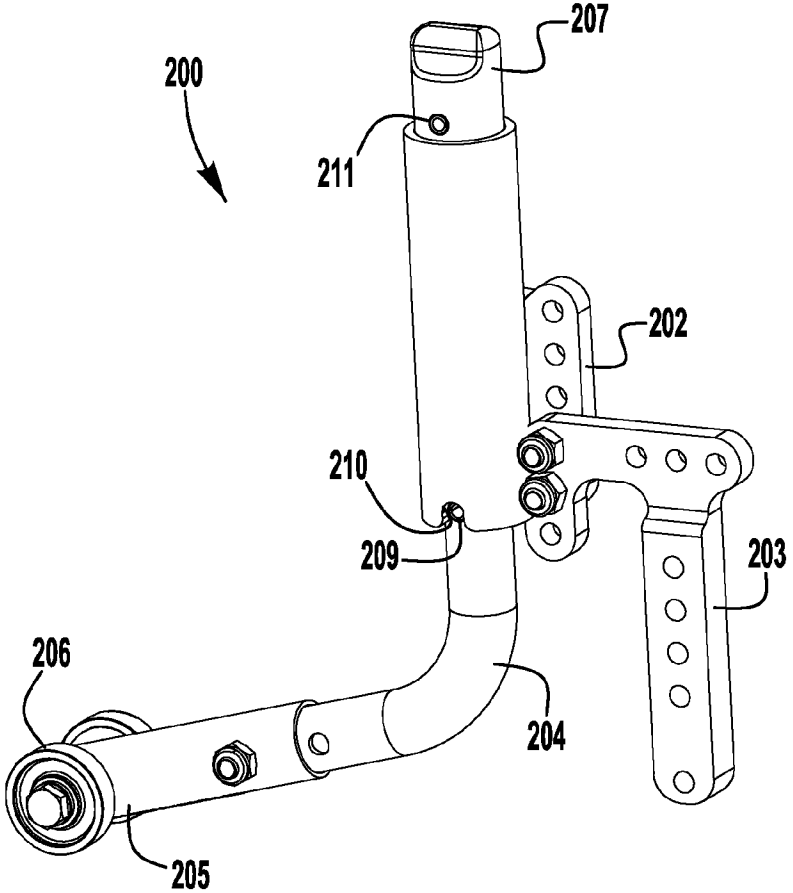
FIG. 9 is a perspective view of the anti-tip leg assembly of FIG. 8, shown in an alternative mounting configuration.
Figure 8:
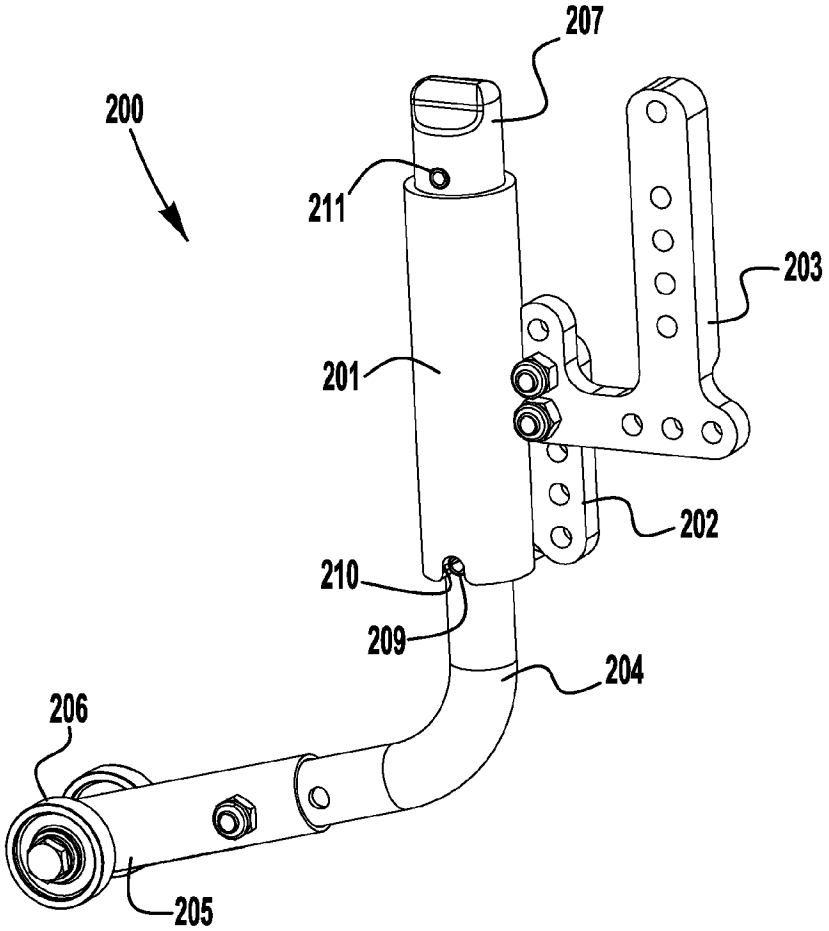
FIG. 8 is a perspective view of an anti-tip leg assembly for a wheelchair in accordance with an exemplary embodiment.
Figure 10:
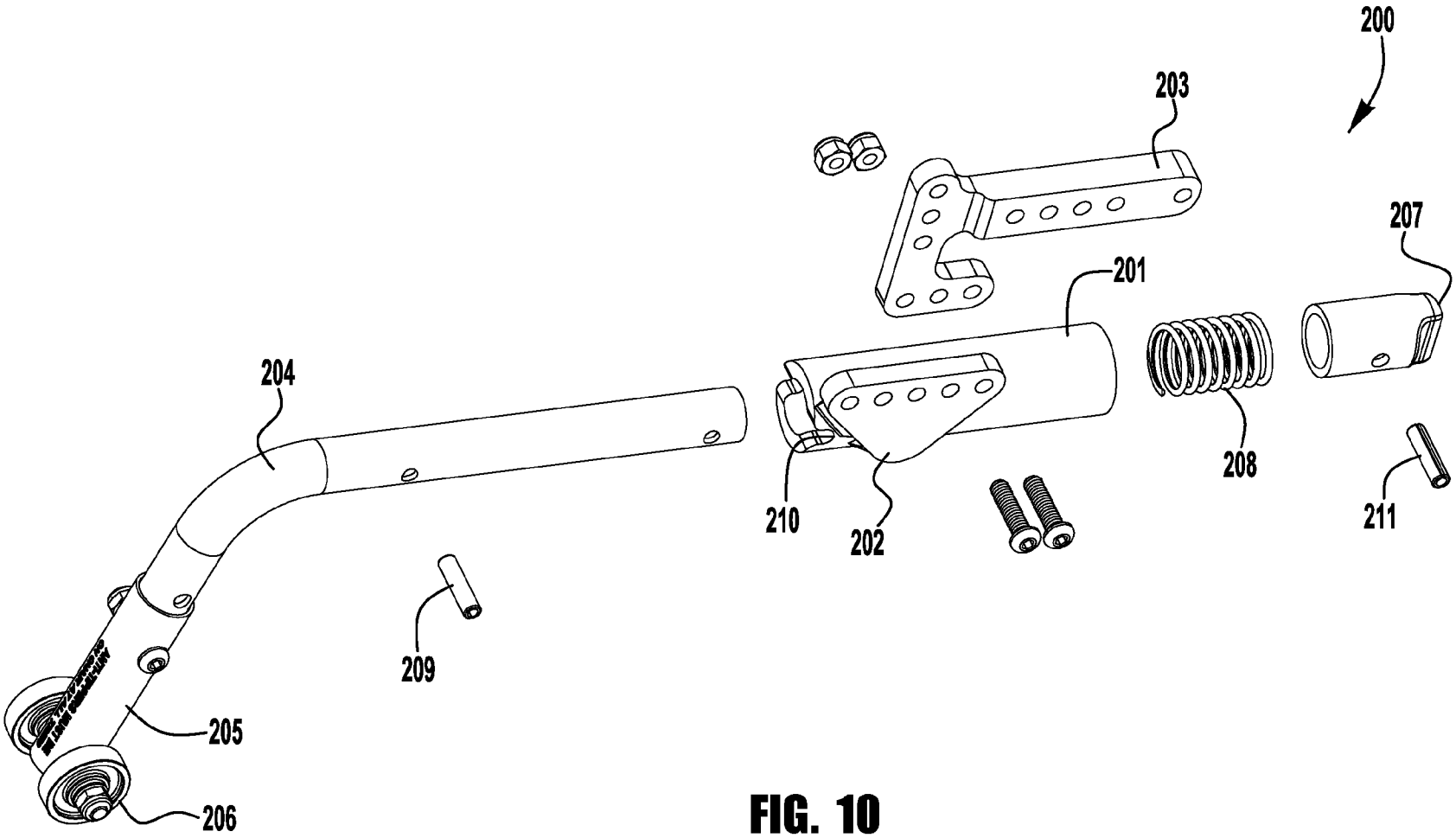
FIG. 10 is an exploded perspective view of the anti-tip leg assembly of FIG. 8.

FIGS. 8-10 illustrate an exemplary anti-tip let assembly 200 including a base portion 201 having a welded mounting plate 202 fastenable (e.g., by bolts or other fasteners) to a J-shaped mounting bracket 203. The anti-tip assembly 200 may be installed at the rear of the base frame 120 by attachment of the mounting bracket 203 to the rear portion of the base side frame members 170*a*, 170*b* and the rear vertical frame tube 195*a*, 195*b*. Multiple mounting apertures on the mounting bracket 203 and on the base side frame members and rear vertical frame tubes allow for positioning of the anti-tip assemblies (one on each side) on the base frame in a position selected to correspond to the rear wheel size and position, to provide sufficient support when the wheelchair is inadvertently tipped. Further, the J-shaped mounting bracket 203 may be flipped or rotated for multiple attachment orientations on the mounting plate 202, for further adjustable positioning of the anti-tip assembly, as shown, for example, in FIG. 9.

As shown, the exemplary anti-tip assembly 200 includes a tubular bent leg portion 204 that is telescopically received in the base portion 201, and a tubular caster carrying end portion 205 that telescopically receives a distal end of the bent leg portion 204. Multiple mounting holes in the distal end of the bent leg portion allow for primarily horizontal adjustment of the caster 206. To allow the anti-tip leg portion 204 to be flipped or rotated, for example, out of the way of a caregiver pushing the wheelchair, or toward the wheelchair frame to more easily stow the wheelchair, a hand or foot actuable plunger end 207 is fastened to a proximal end of the bent leg portion 204 (e.g., by a press fit roll pin 211), and the leg portion 204 is spring loaded (by internal spring 208) into a rotationally fixed position with the base portion 201, by engagement of a central through pin 209 in the bent leg portion 204 with a notch 210 in the base portion. To pivot the bent leg portion 204 out of the anti-tip position, the plunger end 207 is depressed to disengage the through pin 209 from the notch 210, and the plunger end (which may be flatted for easier grasping) is rotated to rotate the leg portion 204 to a withdrawn or disengaged position. If the bent leg portion is rotated to a disengaged position 180° from the anti-tip position, the leg portion may be released (by releasing the plunger end) for spring biased reengagement of the pin 209 with the notch 210.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. An adjustable wheelchair comprising:

a base frame comprising a first guide portion defining a first arcuate channel;

a seat frame comprising a second guide portion defining a second arcuate channel confronting the first arcuate channel;

a first bearing assembly secured to a front end of the first arcuate channel and extending into bearing engagement with the second arcuate channel;

a second bearing assembly secured to a rear end of the second arcuate channel and extending into bearing engagement with the first arcuate channel;

wherein the seat frame is slideable in an arcuate path defined by the first and second arcuate channels for adjustment of a tilt angle of the seat frame with respect to the base frame.

2. The adjustable wheelchair of claim 1, further comprising a latch mechanism secured to one of the first guide portion and the second guide portion for selectively connecting with one of a plurality of latch points on the other of the first guide portion and the second guide portion.

3. The adjustable wheelchair of claim 2, wherein the latch mechanism comprises a retractable bolt, and the plurality of latch points comprises a series of recesses sized to receive the retractable bolt.

4. The adjustable wheelchair of claim 3, wherein the retractable bolt is actuated by a cable tensioning actuator.

5. The adjustable wheelchair of claim 1, wherein the first bearing assembly comprises a horizontal roller bearing in bearing engagement with a bottom surface of the second arcuate channel and a vertical roller bearing in bearing engagement with opposed side surfaces of the second arcuate channel.

6. The adjustable wheelchair of claim 1, wherein the second bearing assembly comprises a horizontal roller bearing in bearing engagement with a bottom surface of the first arcuate channel and a vertical roller bearing in bearing engagement with opposed side surfaces of the first arcuate channel.

7. The adjustable wheelchair of claim 1 further comprising a wiper plate attached to one of the first and second guide portions and extending into the other of the first and second channels to wipe debris from the other of the first and second channels when the seat frame slides in the arcuate path.

8. The adjustable wheelchair of claim 1, wherein the base frame further comprises a third guide portion defining a third arcuate channel, and the seat frame further comprises a fourth guide portion defining a fourth arcuate channel confronting the third arcuate channel, with a third bearing assembly secured to a front end of the third arcuate channel and extending into bearing engagement with the fourth arcuate channel, and a fourth bearing assembly secured to a rear end of the fourth arcuate channel and extending into bearing engagement with the third arcuate channel.

9. The adjustable wheelchair of claim 1, wherein the seat frame further comprises:

a front cross member attached to a front end of the first guide portion;

a rear cross member longitudinally spaced from the front cross member and attached to a rear end of the first guide portion;

a longitudinally extending first side frame member mounted to a first end portion of each of the front and rear cross members by first front and rear mounting brackets; and a longitudinally extending second side frame member mounted to a second end portion of each of the front and rear cross members by second front and rear mounting brackets, the first and second side frame members defining a seating area;

wherein each of the first and second side frame members is independently longitudinally adjustable with respect to the front and rear cross members.

10. The adjustable wheelchair of claim 1, wherein the seat frame further comprises:

a front cross member attached to a front end of the first guide portion;

a rear cross member longitudinally spaced from the front cross member and attached to a rear end of the first guide portion;

a longitudinally extending first side frame member mounted to a first end portion of each of the front and rear cross members, and including a cylindrical portion and a flatted cylindrical portion;

a longitudinally extending second side frame member mounted to a second end portion of each of the front and rear cross members, the first and second side frame members defining a seating area, and including a cylindrical portion and a flatted cylindrical portion;

a first mounting bracket having a C-clamp end portion attached to the cylindrical portion of one of the first and second side frame members; and a second mounting bracket having flat first and second side walls attached to the flatted cylindrical portion of one of the first and second side frame members.

11. The adjustable wheelchair of claim 1, further comprising a front wheel caster assembly including a caster wheel rotatably secured to a stem portion, the stem portion being affixed to a mounting bracket mounted to a front end portion of the base frame, the mounting bracket including a first aperture closely receiving a first fastener threaded with an aligned first mounting hole in the front end portion of the base frame, an elongated second mounting aperture vertically spaced from, and longitudinally aligned with the first mounting aperture, receiving a second fastener threaded with an aligned second mounting hole in the front end portion of the base frame, and an eccentric third mounting aperture longitudinally spaced from the first and second mounting apertures, with an eccentric camming plate received in the eccentric third mounting aperture and including a third fastener extending therethrough and threaded with a third mounting hole in the front end portion of the base frame, the eccentric camming plate being tightened with the eccentric mounting hole by the third fastener to secure the front wheel caster in a selected angular position.

12. The adjustable wheelchair of claim 1, further comprising a rear wheel rotatable about an axle secured to a rear end portion of the side frame member, and an anti-tip leg assembly including a hollow base portion affixed to the rear end portion of the side frame member, rearward of the axle, a leg portion extending axially through the hollow base portion from a first end proximate the side frame member to a distal end having a ground engaging portion configured to support the wheelchair if the base frame is accidentally tipped rearward about the rear wheel, the leg portion being axially biased into a rotationally fixed position with the ground engaging portion in an anti-tip position, wherein the first end of the leg portion is axially movable to a rotatable position to permit rotation of the leg portion for movement of the ground engaging portion to a disengaged position.

13. The adjustable wheelchair of claim 12, wherein the base portion of the anti-tip leg assembly is affixed to the rear end portion of the side frame member by a mounting bracket having multiple mounting apertures for selective alignment with multiple mounting holes in the side frame member, for adjustment of an orientation of the anti-tip leg assembly with respect to the side frame member.

* * * * *